US006377157B1

(12) United States Patent
Liu et al.

(10) Patent No.: US 6,377,157 B1
(45) Date of Patent: Apr. 23, 2002

(54) CONTINUOUS MULTI-TURN COILS

(75) Inventors: Hanson Liu, Brighton; Pi-Yao Aileen Liu, Newton, both of MA (US)

(73) Assignee: International Power Devices, Inc., Boston, MA (US)

( * ) Notice: Subject to any disclaimer, the term of this patent is extended or adjusted under 35 U.S.C. 154(b) by 0 days.

(21) Appl. No.: 09/641,022

(22) Filed: Aug. 17, 2000

Related U.S. Application Data

(62) Division of application No. 09/440,378, filed on Nov. 15, 1999, now Pat. No. 6,204,745.

(51) Int. Cl.[7] ..... H01F 5/00
(52) U.S. Cl. ..... 336/223; 336/200; 336/232
(58) Field of Search ..... 336/200, 223, 336/225, 232

(56) References Cited

U.S. PATENT DOCUMENTS

| | | | |
|---|---|---|---|
| 2,943,966 | A | 7/1960 | Leno et al. |
| 3,609,600 | A | 9/1971 | Kassabgi |
| 5,781,093 | A | 7/1998 | Grandmont et al. |

FOREIGN PATENT DOCUMENTS

| | | | |
|---|---|---|---|
| DE | 197 25 865 | A1 | 1/1998 |
| DE | 299 07 945 | U1 | 8/1999 |
| EP | 0 662 699 | A1 | 7/1995 |
| GB | 2 332 100 | | 6/1999 |
| SU | 665-334 | | 5/1979 |

*Primary Examiner*—Anh Mai
(74) *Attorney, Agent, or Firm*—Fish & Richardson P.C.

(57) ABSTRACT

A coil element with no solder joints is made of a continuous conductive strip includes a first terminal, a second terminal, a conductive path between the first terminal and the second terminal. The conductive path has curved regions and foldable hinge regions shaped such that the coil element may be folded into single or multi-turn coils for use in transformers and other electronic devices.

11 Claims, 15 Drawing Sheets

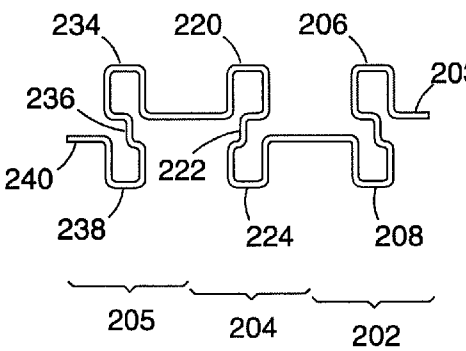
Fig. 15A
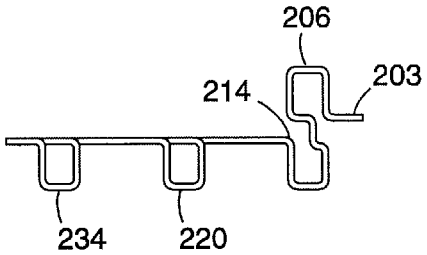
Fig. 15B
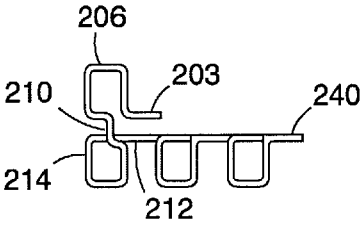
Fig. 15C
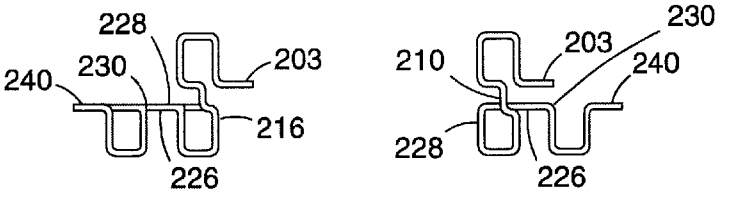
Fig. 15D
Fig. 15E
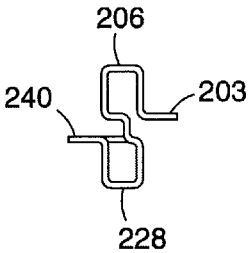
Fig. 15F
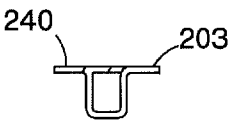
Fig. 15G

CONTINUOUS MULTI-TURN COILS

This application is a divisional of U.S. application Ser. No. 09/440,378, filed Nov. 15, 1999 is now U.S. Pat. No. 6,204,745.

BACKGROUND OF THE INVENTION

1. Field of the Invention

The present invention relates to conductive coils for use in inductors, transformers and other electrical or electronic devices.

2. Description of Related Art

Coils may be used as circuit elements in a wide variety of electrical and electronic devices, and are used extensively as windings for inductor/transformers. Conventional multi-turn and thick single turn coils consist of multiple pieces of conductive material soldered together in series or in parallel. Each piece of conductive material requires a solder joint to be electrically connected into a continuous conductive path. Circuit elements with solder joints require expensive and time consuming soldering steps that significantly increase manufacturing costs. In addition, a current passing through a solder joint encounters significantly more electrical resistance at the solder-substrate interface than a jointless conductive path. As electronic devices are reduced in size, the solder joints become increasingly difficult to bond, and each solder joint along a conductive path becomes a potential source of defects. These defects may ultimately cause failure of the electronic device. Even a solder joint that is defect-free during production can become a likely candidate for failure once the electronic device is exposed to moisture, vibration and temperature extremes.

SUMMARY OF THE INVENTION

It would be desirable in the art to provide a winding that does not require solder joints for assembly. This winding would be easier to manufacture, exhibit fewer manufacturing defects, and be more reliable in operation. The present invention addresses these requirements by providing a continuous, conductive coil for use in electronic devices such as transformers, circuit boards and the like. The coils of the present invention are made of a continuous length of a conductive material, and require no solder joints to create an efficient, low-loss winding for transformers and other electronic devices. The present invention includes designs for both single turn and multi-turn coils.

Single Turn Coils

Single turn coils are widely used as windings in inductors/transformers and other electronic devices. To reduce power loss when designing windings, the length of the winding is generally minimized, and its cross-sectional area or thickness increased. Increases in the thickness or the cross-sectional area of the turns in windings reduce power losses in the finished device, but these thick materials are difficult and expensive to manufacture. Thick pieces of metal (typically copper) in a finished device are also difficult to electrically insulate.

Conventional thick, single turn multi-turn wound coils consist of multiple pieces of conductive material. Each piece of conductive material requires a solder joint to be electrically connected into a continuous conductive path. To eliminate the need to join two thinner turns of conductive material to make a thick single-turn wound coil, one embodiment of the present invention is a conductive element that may be folded into a single turn. This conductive element is made of one continuous piece of a conductive material and includes a first terminal, a second terminal and a continuous conductive path between the first terminal and the second terminal. In one embodiment, the conductive path includes a first curve, a second curve, and a foldable hinge region between the first curve and the second curve. In certain embodiments, within the first and second curves, apertures may be sized to accept a specific magnetic core configuration that provides a flux path for the magnetic field generated by the winding.

After the coil element is shaped for a particular application, the conductive elements are insulated by laminating the element between at least two layers of relatively thin sheets of an insulative material. The insulating layers create a highly reliable seal that ensures high voltage isolation between the windings. In addition, the seal prevents moisture contamination when an electronic assembly that includes the winding is exposed to a high pressure "water-washing" processes during manufacture.

Following the lamination step, the conductive element is folded at the foldable hinge region to form a single-turn winding. The conductive element is folded such that the current travels around each curve of the conductive path in a single direction. The turns need not be oriented in any specific way following the folding step, but for improved performance the first curve should lie in a first plane and the second curve should lie in a second plane. The first plane and the second plane are preferably substantially-parallel to one another, and the first turn and the second turn overlie one another. After the folding steps are completed, the curves of the winding may optionally be adhered to one another using a suitable adhesive. The completed winding may then be associated with a magnetic core that fits inside the apertures.

2-Turn Coil

Another embodiment is a coil element that may be folded into a conductive coil with two turns. The coil element is made of a continuous strip of a conductive material and includes a first terminal, a second terminal, and a conductive path between the first terminal and the second terminal. The conductive path includes a first turn connected to the first terminal, a second turn connected to the second terminal, and a foldable hinge region between the first and the second turns.

After the coil element is shaped for a particular application, the element is laminated in layers of an insulative material as described above. The insulative material may be removed from the apertures inside the first and second turns to create an opening to accept a magnetic core.

The laminated coil element may be folded about the foldable hinge region to form a continuous conductive coil with turns in substantially parallel planes, although such an orientation is not required. For example, the coil includes a first terminal connected to a first turn in first plane. A second turn is in a second plane substantially parallel to the first plane. The first turn and the second turn are connected via the foldable hinge region, which spans the first and second planes. The second turn connects to a second terminal. The first and second turns are positioned adjacent one another in the parallel planes, and substantially overlie one another. The turns may then optionally be adhered to each other to reduce noise and vibration in the coil under high current conditions. Because each turn is individually sealed, the adhesive used in adhering them need not be relied upon to provide a moisture-impervious seal.

Multi-turn Coils

To make a coil with more than two turns, the basic coil elements described above may be linked in series to form a coil element with multiple turns. The conductive coil element used to make a multi-turn coil is a continuous conductive strip including a first terminal, a second terminal, and a conductive path between the first and the second terminal. The conductive path includes an arrangement of conductive regions linked together in series by a connector region between each conductive region. The conductive regions have at least one and no more than two turns. If a conductive region has a single turn, the turn in that conductive region is connected to an adjacent conductive region in the series by a connector region. If a conductive region has two turns, the turns in that conductive region are connected to each other by a foldable hinge region. If two adjacent turns in the series are connected by a connector region, a current travels around each turn in the same direction. If two adjacent turns in the series are connected by a foldable hinge region, and the turns are assumed to lie in the x-y plane, a current travels in opposite directions relative to the z axis in each turn on either side of the foldable hinge region. This turn arrangement ensures that a current will flow in the same direction around the turns of the folded, completed coil.

Once the conductive element is shaped with a primary conductive region and the desired number of secondary conductive regions, the conductive element may be insulated as described above. The laminated conductive element may then be folded about the connector regions and foldable hinge regions to create a coil with a desired number of turns in a specific arrangement.

If the conductive element requires 5 or more turns (n>4), a specific folding protocol is preferred. First, the paired turns in each second conductive region are folded at the junction of their respective foldable hinge regions so that the turns in each pair substantially overlie one another. The connector region linking the first conductive region and the nearest second conductive region is then folded about its first end until the connector region lies above or behind the foldable hinge region in the first conductive region. Each successive connector region closest to the first conductive region is then folded about the foldable hinge region of the first conductive region.

After this step is completed, all turns in each second conductive region lie in adjacent parallel planes. Finally, the turns in the first conductive region are bent and folded about their foldable hinge region such that all the turns in the conductive element overlie one another. Although a specific orientation is not required, for optimal performance the turns should substantially overlie one another in parallel planes and form a multi-turn coil.

The turns of the coil may then optionally be bonded together with an adhesive. The resultant coil may then be associated with a core and other winding elements to form a transformer or incorporated into any electronic circuit or device.

The continuous multi-turn coil of the present invention requires no solder joints. This reduces time-consuming soldering steps, which would be expected to significantly reduce manufacturing costs. The reduced number of soldering steps means that the coils of the present invention may be made smaller and with fewer manufacturing defects than conventional devices. The reduced number of soldering solder joints also makes the coils of the present invention more reliable under demanding environmental conditions.

The fabrication and sealing process for making the coil elements of the present invention is highly repeatable. Each turn of the coil element may be shaped for use in a wide variety of transformers or other magnetic coil component configurations. A large number of transformers or magnetic coil components may be constructed from a limited number of winding configurations simply by coupling the winding to other winding elements such as, for example, a printed circuit board or another winding.

The details of one or more embodiments of the invention are set forth in the accompanying drawings and the description below. Other features, objects, and advantages of the invention will be apparent from the description and the drawings, and from the claims.

BRIEF DESCRIPTION OF THE DRAWINGS

FIGS. 15A–15F illustrate a folding procedure for making a coil from the six-turn coil element of FIG. 14.

DETAILED DESCRIPTION

Single Turn Coil

Figure 1:
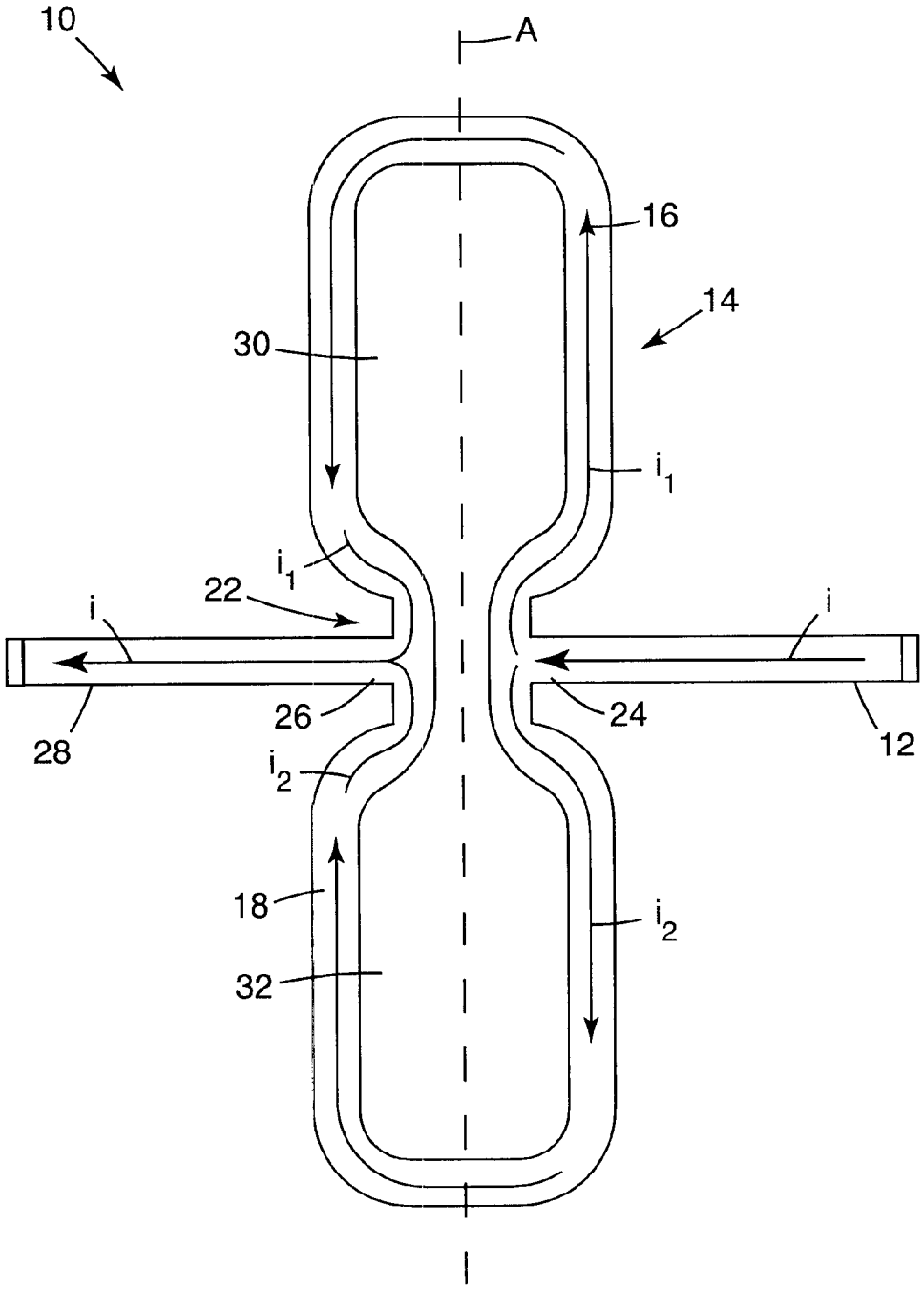
FIG. 1 is an overhead view of an embodiment of a coil element of the present invention having two substantially U-shaped curves.

FIG. 1 illustrates an embodiment of a continuous conductive coil element of the present invention 10 that is shaped for folding into a single turn winding.

The coil element 10 is made of a substantially flat, continuous strip of a conductive material. Suitable materials for use in the coil element 10 include any ductile conductive metal, such as, for example, copper, aluminum, silver, and gold, and mixtures and alloys thereof. Copper and its alloys are preferred for their relatively low cost and high electrical conductivity. The cross-sectional shape of the coil element 10 may be selected for the intended application, but, typically, a substantially rectangular cross section is preferred, with a height h and a width w that are substantially less than the length of the element 10. The coil elements typically have a thickness between about 0.010 inches and about 0.040 inches (0.025–0.010 cm).

A stamping or photochemical etching process may be used to make the coil elements. In the development of prototype designs, the metal strips may also be formed with a wire electronic discharge machining (EDM) process. Depending on the particular process used to form the metal strips, various finishing operations may be required. For example, following stamping and cleaning of the metal strips, a coining process may be used to remove burrs from the edges of the strips. A micro-etching step may also be performed after coining in preparation for a plating operation.

When the coil element is folded into a coil, the shape of the continuous conductive path determines the number of turns in the coil, as well as the shape of each turn in the coil. The shape of the continuous conductive path may be viewed as being composed of arcuate and/or linear subdivisions that intersect to form a desired shape. The arcuate and linear subdivisions may have any shape, although certain preferred shapes would be expected to provide a coil with low noise and enhanced efficiency. For example, a coil with smooth turns would be expected to be more efficient and produce less electromagnetic interference, so the conductive path preferably has a substantially arcuate shape.

This coil element 10 includes a first terminal 12 and a second terminal 28 with a continuous conductive path 14 between them. The conductive path 14 may have any shape required for a particular application. The conductive path 14 illustrated in FIG. 1 includes a first substantially U-shaped curve 16 and a second substantially U-shaped curve 18, and a foldable hinge region 22 between them. The foldable hinge region 22 may have any shape required for a particular application, as long as following folding, a current travels in substantially the same direction around the conductive path 14.

The foldable hinge region 22 includes a branch 24 and a junction 26 connected between the first curve 16 and the second curve 18. The branch and the junction may have any shape, and need not have the same shape. In this embodiment the branch 24 and the junction 26 are substantially T-shaped, and are substantially coplanar and are mirror images of one another about a line A—A bisecting the foldable hinge region 22. The branch 24 is connected to the first terminal 12 and the junction 26 is connected to the second terminal 28.

The branch 24 and the junction 26 may have any desired shape. In this embodiment the branch 24 and the junction 26 are shaped substantially like the letter T. The branch 24 and the junction 26 are substantially coplanar and are mirror images of one another about line A—A. Within the first and second curves, apertures 30, 32, respectively, may be sized to accept a specific magnetic core configuration.

In operation, a current i entering the first terminal 12 encounters the branch 24 and is split into two currents, a first current $i_1$ in the curve 16 and a second current $i_2$ in the curve 18. In the folded configuration, the currents $i_1$ and $i_2$ travel in parallel around the first and second curves 16, 18, respectively. The currents $i_1$ and $i_2$ then merge to reform current i at the junction 26 before exiting the coil at the second lead 28.

After the coil element 10 is formed, it is preferably insulated to prevent moisture contamination. The insulation may be applied as a coating over the curves 16, 18 and the hinge region 22, or these portions of the coil element 10 may be laminated between at least two layers of a non-conductive material. Preferred insulative materials include polymeric films, and polyimide films are particularly preferred. The insulating layers create a highly reliable seal that ensures high voltage isolation between the windings, even when the windings are operated at temperatures up to about 120° C. In addition, the seal prevents moisture contamination when the electronic assemblies (e.g., circuit boards) that include the windings are exposed to high-pressure "water-washing" processes during manufacture.

The lamination procedure used to insulate the coil elements of the present invention is described in U.S. Pat. No. 5,781,093 to Grandmont et al., which is incorporated herein by reference. In this process the coil element 10 is typically thermally bonded within the insulative sheets by applying heat and pressure to the insulative sheets using a differential lamination apparatus. The coil element 10 becomes individually encapsulated between a pair of insulative sheets having a thickness between about 0.0005 and about 0.001 inches (0.0013 cm–0.0025 cm). Preferably, a polyimide film having a thermally bondable acrylic adhesive coating is used to insulate the coil elements. A polyimide film available under the trade designations Pyralux or Kapton from E. I Dupont de Nemous & Co., Wilmington, Del., USA, is particularly well suited for encapsulating metal strips to ensure a moisture impervious seal. The differential pressure lamination apparatus provides a vacuum to eliminate any air between the insulative sheets and ensure an effective seal. Conformal press pads may be used to apply the pressure to the winding structure.

Figure 2:
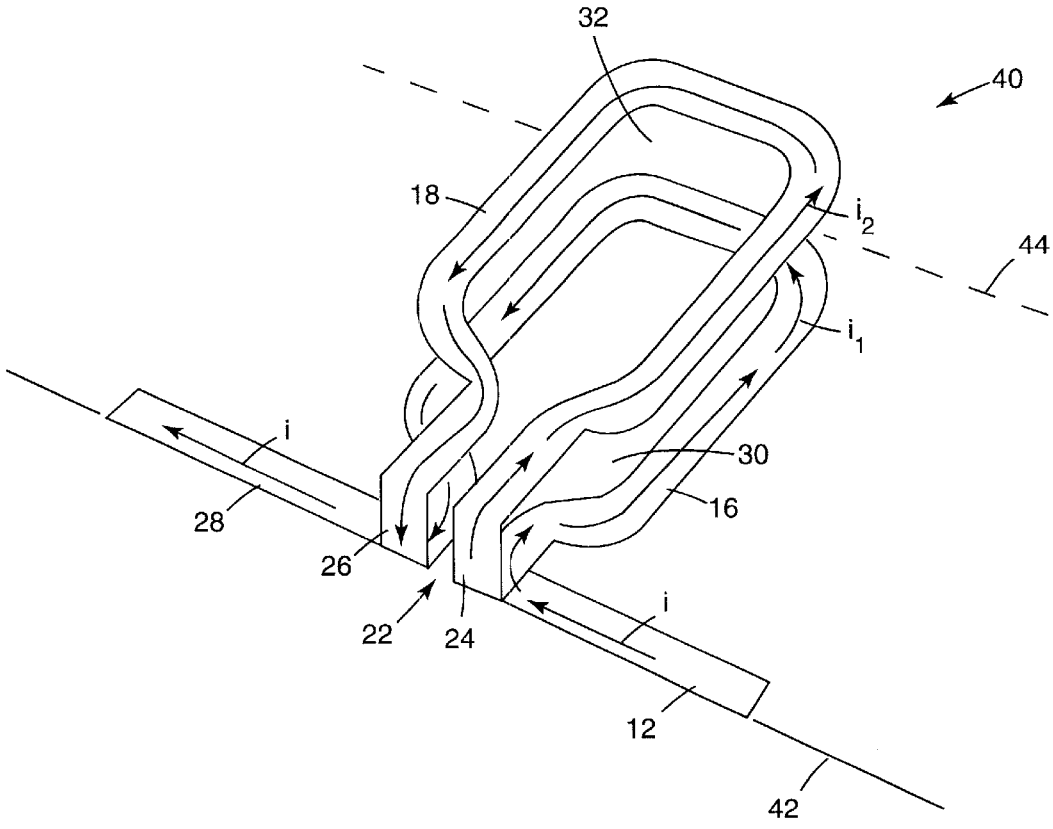
FIG. 2 is a perspective view of a single turn coil made by folding the coil element of FIG. 1 about its foldable hinge region.

Referring to FIG. 2, following the lamination step, the conductive element 10 of FIG. 1 is folded about the foldable hinge region 22 to form a single turn winding 40. The conductive element 10 is folded at the hinge region 22 such that the first and second substantially U-shaped curves 16, 18 substantially overlie one another in substantially parallel planes 42, 44, respectively. The branch 24 and the junction 26 span the parallel planes 42, 44. The first and second terminals 12, 28 may be easily bent to match any shape of a surface mount pad above or below.

Figure 3:
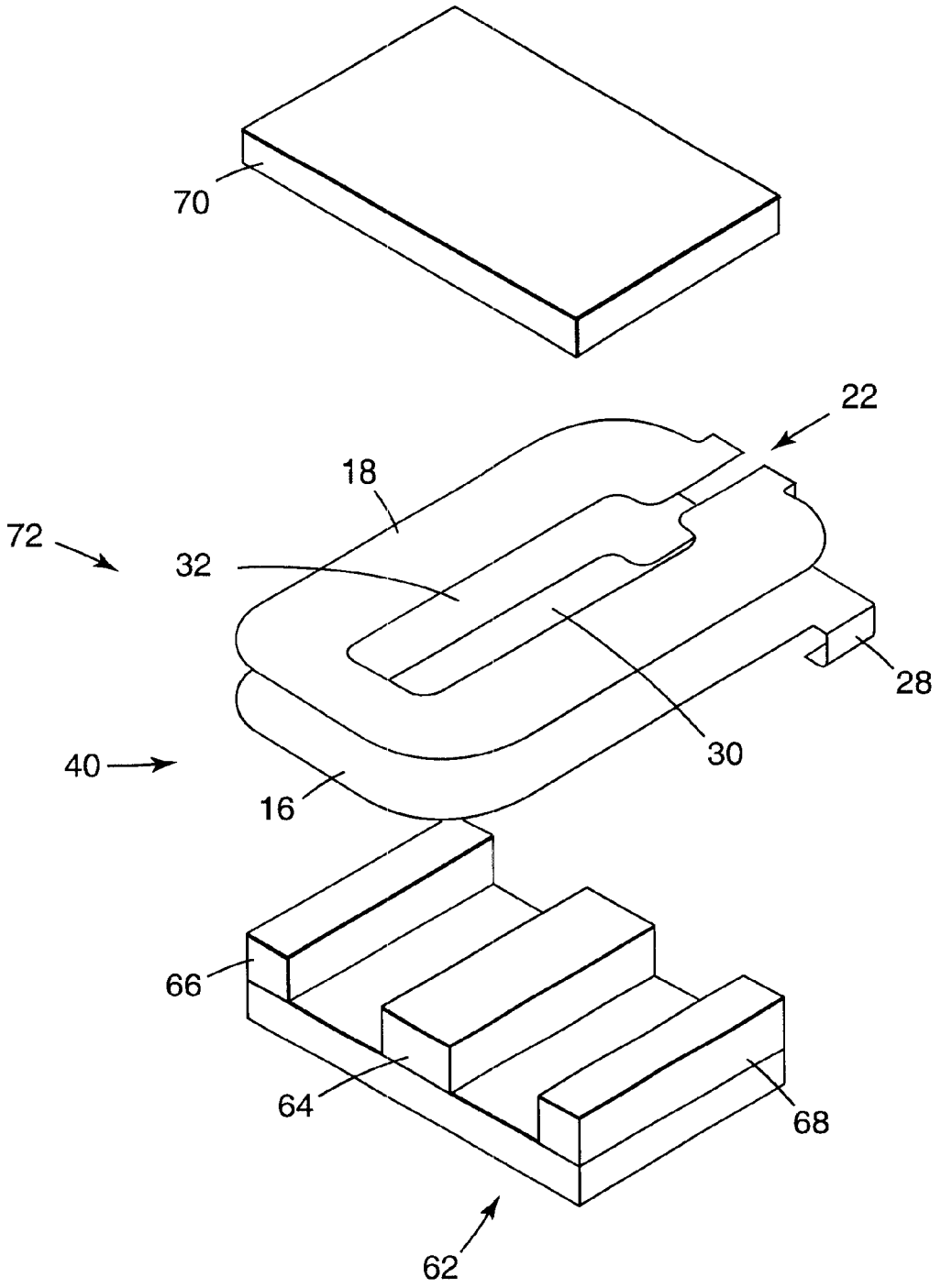
FIG. 3 is an exploded perspective view of a single turn coil of FIG. 2 in a magnetic core.

After the completion of the folding procedure, the curves 16, 18 of the winding may optionally be adhered to one another using a suitable adhesive. Then, as shown in FIG. 3, the substantially aligned apertures 30, 32 formed by the stacked overlain curves in the coil member 40 are sized to accept a magnetic base member 62. The base member 62, which is typically made of a sintered ferrite or other magnetically susceptible material, is typically E-shaped and includes a center channel 64 and peripheral channels 66, 68. The aligned apertures 30, 32 in the coil 40 are placed over the center channel 64 such that the turn of the coil rests between the peripheral channels 66, 68. A top member 70 is then used to complete the magnetic core housing 72.

Two-Turn Coil

Figure 4:
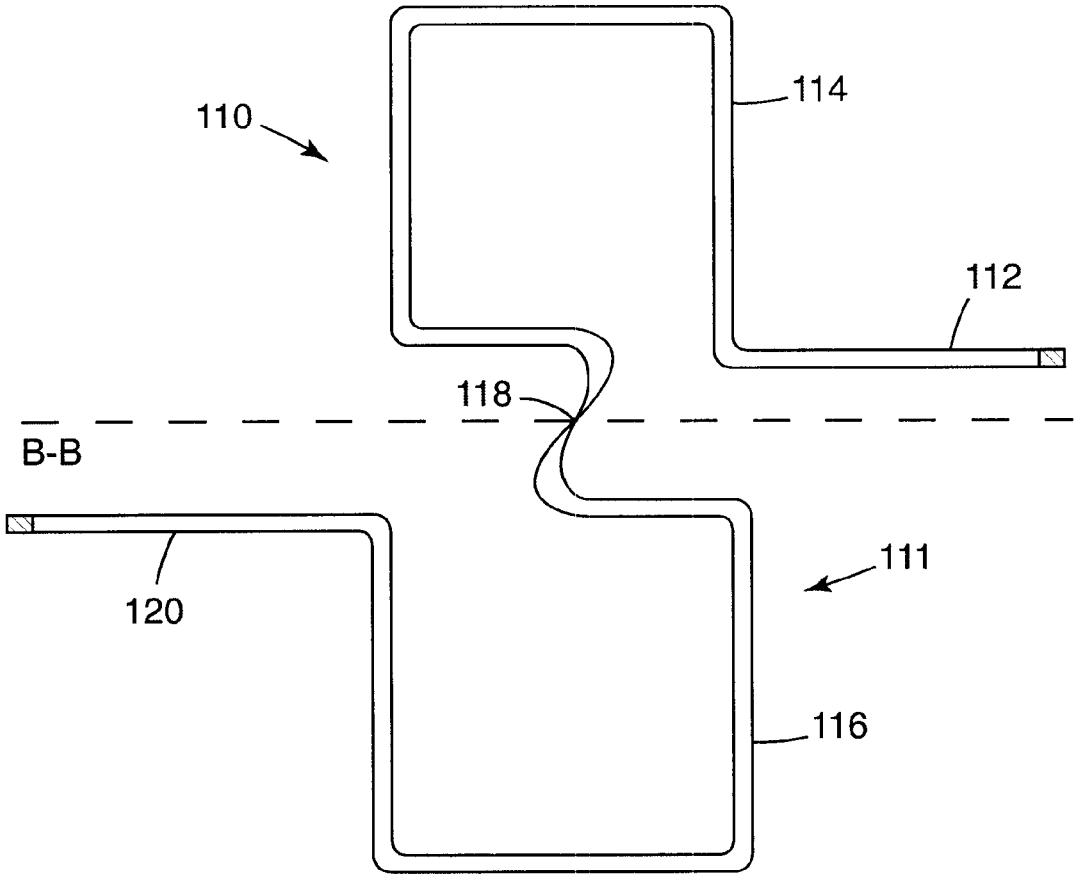
FIG. 4 is a perspective view of an embodiment of a coil element of the present invention having two turns.

Referring to FIG. 4, another embodiment of a coil element is shown that may be used to form a two-turn coil. The coil element 110 includes a first terminal 112 and a second terminal 120 with a conductive path 111 between them. As with the conductive path 14 in the single turn embodiment shown above in FIG. 1, the conductive path 111 in FIG. 4 may have any shape required by a particular application. In the embodiment shown in FIG. 4, the conductive path 111 includes a first turn 114 connected to the first terminal 112, and a second turn 116 connected to a second terminal 120. As discussed above, the shapes of the first and second turns may be the same or different, and each turn may be shaped for a particular application. To provide a coil with optimum electrical properties, the first and second turns should have a substantially arcuate shape, and in this embodiment the first and second turns are shaped substantially like the letter U. A foldable hinge region 118 lies between the first turn and the second turn and crosses the symmetry axis B—B of the element 110. The foldable hinge region 118 may have any desired shape, as long as following the folding step described below, a current travels in a single direction around each of the turns in the completed coil. A second terminal 120 is connected to the second turn 116.

Figure 5:
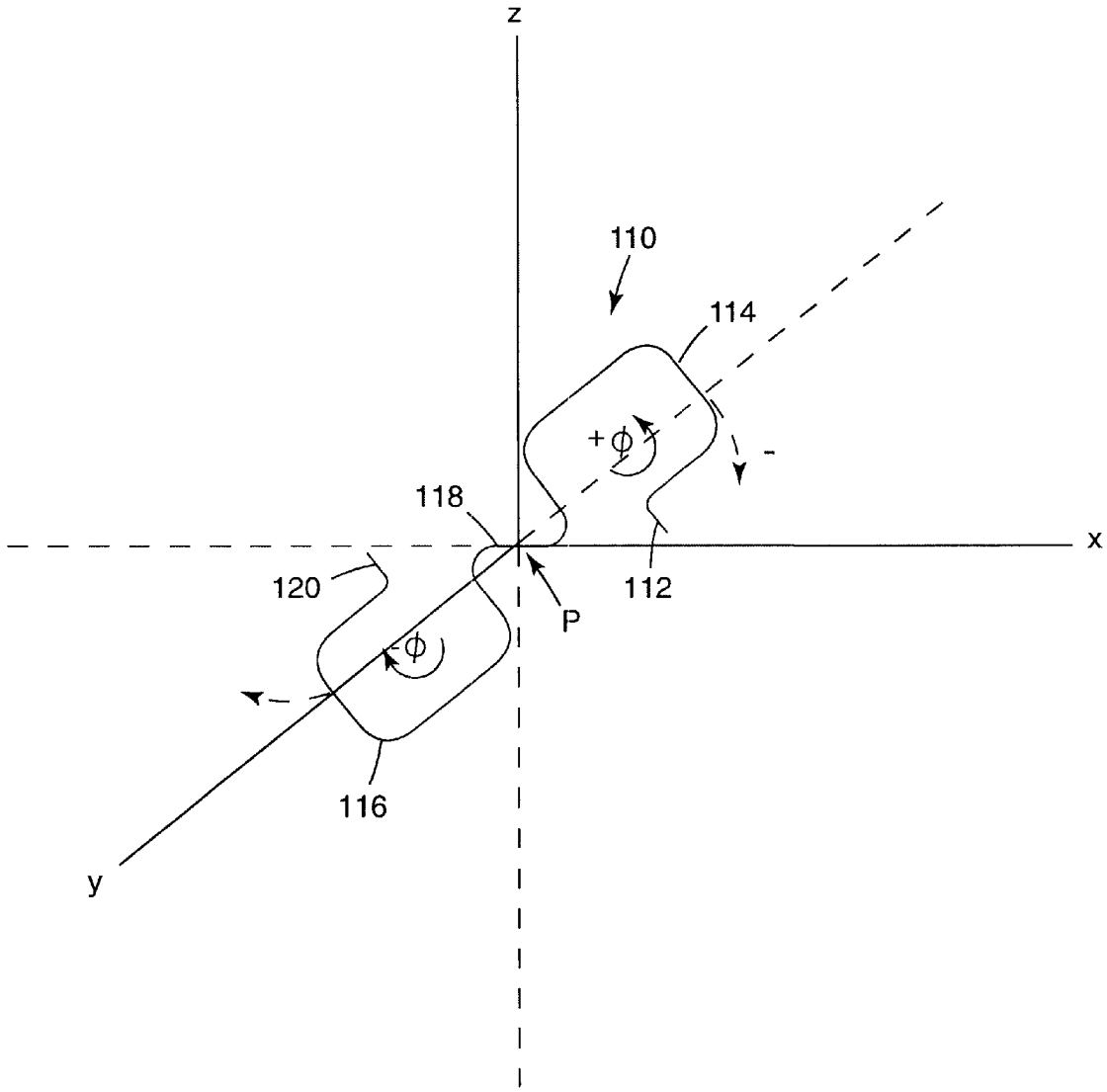
FIG. 5 is a perspective view of the coil element of FIG. 4, prior to folding about the hinge region.

Referring to FIG. 5, the laminated coil element 110 is shown in the x-y plane. A preferred shape for the coil element 110 resembles the letter S. In such a configuration the first and second turns 114, 116 are rotationally symmetrical to one another. If the first turn 114 is rotated 180° in the x-y plane about the hinge region 118, the first turn 114 will overlie the second turn 116. Similarly, if the second turn 116 is rotated 180° in the x-y plane about the hinge region 118, the second turn 116 will overlie the first turn 114.

To make a coil, the coil element 110 may be folded about the foldable hinge region 118. To locate the foldable hinge region, assume that a current enters the first terminal 112 and travels around the first turn 114 in a first direction about the z axis $+\phi$. When the current encounters the hinge region, its direction of travel changes and becomes, in the present embodiment, $-\phi$ about the z axis. In this embodiment, the first and second turns of the coil element are rotationally symmetrical about the foldable hinge region 118, and the hinge region is located on the point P of symmetry between the turns at the origin of the coordinate system. However, if the turns are not symmetrical, the hinge region may be considered as the region where the direction of current travel changes in sign, from positive (+) to negative (−) or negative to positive with respect to the z axis. The folding procedure may vary depending on the desired location of the first terminal 112 and the second terminal 120. In FIG. 5, to fold the coil element 110, the first turn 114 may be moved through an angle $-\alpha$ in the y-z plane until the coil element 110 folds on itself through the hinge region 118. In the alternative, the second turn 116 may be moved through an angle $+\alpha$ in the y-z plane until the coil element 110 folds on itself through the hinge region 118.

Figure 6:
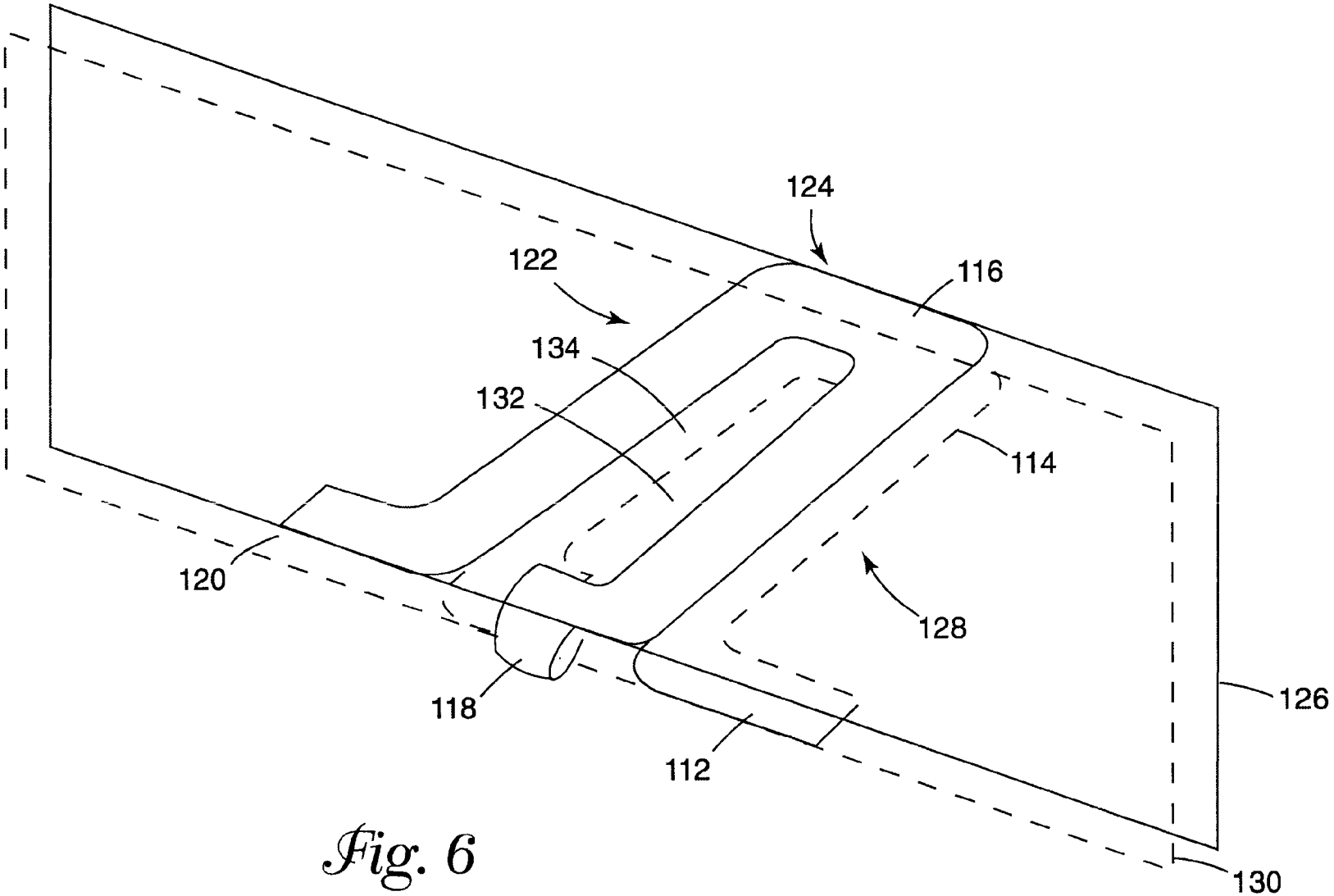
FIG. 6 is a perspective view of a coil made by folding the coil element of FIG. 4.

Referring to FIG. 6, a two-turn coil 122 is shown that results from the folding step outlined in FIG. 5. The coil 122 results from folding the second turn 116 of the coil element 110 through an angle $+\alpha$ about the hinge region 118 until the second turn 116 substantially overlies the first turn 114. The term substantially overlies as used herein means that the first and second turns 114, 116 of the coil element are substantially aligned with each other. Preferably, the first and second turns 114, 116 are aligned and substantially coextensive. The first winding 128 and the first terminal 112 of the coil 122 reside in a first plane 130. The second winding 124 and the second terminal 120 of the coil 122 reside in a second plane 126. The first and second planes 130, 126 are preferably substantially parallel to each other, although such an orientation is not required.

After the completion of the folding steps, the turns 124, 128 may optionally be adhered to one another using a suitable adhesive, such as a thermally curable epoxy. The adhesive strengthens the coil assembly and provides further protection against damage from moisture. The adhesive layers also reduce the noise and vibration that occur when a current passes through the coil. The completed coil may then be associated with a magnetic core (not shown in FIG. 6) that fits inside the aligned apertures 132, 134 inside the windings 128, 124 of the coil 122.

The substantially S-shaped conductive element 110 in FIGS. 4–6 may be linked in series with additional conductive elements of the same or different shapes to create a coil with a specific number of turns engineered for an application in a transformer or other electronic device.

Multi-Turn Coil

To make a coil with more than two turns, a conductive element with an appropriately shaped conductive path may be fabricated. The conductive path is made up of conductive regions that are linked in series by connector regions. Each conductive region may be shaped for a particular application, and may include at least one, but no more than two, turns. The shapes of the turns in each conductive region may be the same or different.

If a conductive region is a single turn, the turn will be connected to an adjacent turn in the series by a connector region. The single turns linked by a connector region may have any shape so long as a current travels around each turn in the same direction in the folded configuration. To provide a coil with optimum electrical properties, the single turn conductive regions are arcuate, preferably shaped substantially like the letter U.

If two turns are present in a conductive region, the turns are connected by a foldable hinge region. The turns may have any desired shape, so long as a current entering the two-turn conductive region travels in opposite directions on each side of the foldable hinge region. As noted above, the foldable hinge region is defined as the area where current travel around a conductive region changes sign from positive (+) to negative (−) with respect to the z axis. To provide a coil with good electrical properties, the turns in the two-turn conductive regions are arcuate, preferably shaped substantially like the letter U. To enhance electrical properties it is preferred that the turns in a two-turn conductive region be paired to form a conductive region resembling the letter S. The two-turn conductive regions may be made into an S-like shape or a reverse S-like shape.

When a multi-turn coil element is folded into a coil, a conductive region with an S-like shape will cancel the inductive effect of an adjacent conductive region with an S-like shape. Likewise, a reverse S-like shape will cancel the inductive effect of an adjacent reverse S-like shape. To ensure that the current flows in one direction to enhance the inductive effect of a coil, an S-like shape should not be positioned adjacent to another S-like shape, and a reverse S-like shape should not be positioned adjacent to another reverse S-like shape. The preferred configuration to achieve an inductive effect is thus alternating S and reverse-S like shaped conductive regions in series: first terminal, S-like shape, reverse S-like shape, S-like shape, reverse S-like shape, . . . second terminal. However, any additional conductive regions with single turns may be inserted into the series as long a the single turns are connected with connector regions. With this arrangement, when the coil element is folded to form a coil, the current passes through all turns of the coil in the same direction.

3 Turn Coils

Figure 7:
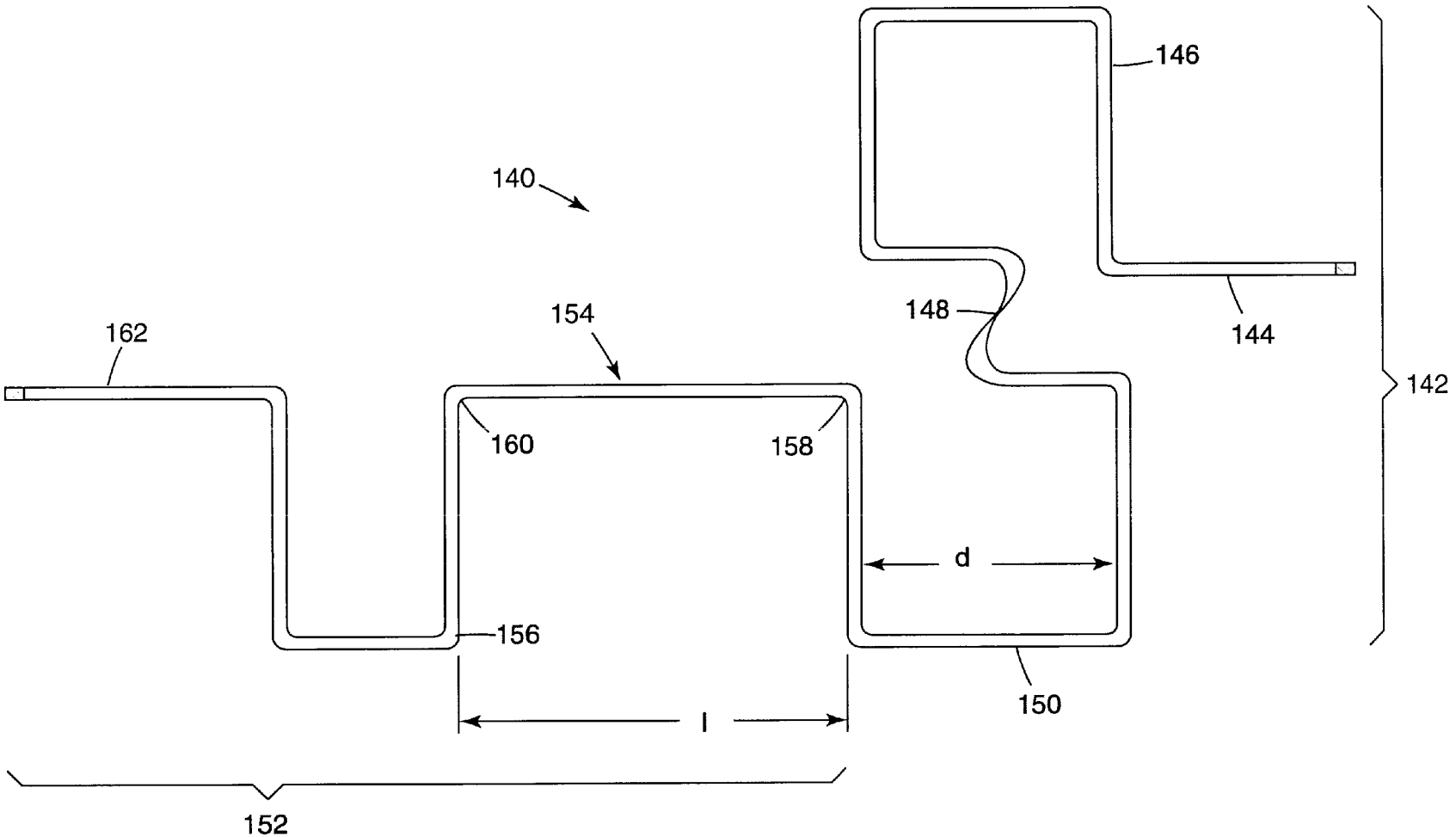
FIG. 7 is an overhead perspective view of an embodiment of a coil element with three turns.

The conductive element 140 shown in FIG. 7 includes a first conductive region 142 with a first terminal 144, a first turn 146, a foldable hinge region 148, and a second turn 150. The first and second turns 146, 150 shown in FIG. 7 are substantially U-shaped and, along with the shape of the hinge region 148, provide a first conductive region that is substantially S-shaped. However, the shapes of the turns and the hinge region, as well as the number of turns in a conductive region, may be altered as required for a particular application. For example, the width of the hinge region 148 may be indented in thick conductive material to allow easier and more repeatable folding.

The output of the second U-shaped turn 150 is connected to a second conductive region 152. In the embodiment of FIG. 7, the second conductive region 152 includes a connector region 154 and one turn 156. The turn 156 is substantially U-shaped, but such a shape is not required. The connector region 154 may have any shape required for a particular application, so long as, following folding of the conductive element into a coil, a current travels around the turns of the coil in a single direction. In this embodiment the connector region 154 is substantially linear, and the length l of the connector region 154 is greater than the distance across the largest dimension d of the substantially U-shaped turns in the adjacent conductive region 142. Providing a connector region of the proper length facilitates folding the coil element into a coil. A first end 158 of the connector region 154 is connected to the output of the conductive region 142. A second end 160 of the connector region is connected to the third substantially U-shaped turn 156. The third U-shaped turn 156 is connected to a second terminal 162, which may be connected to a circuit board, an electronic device or to another conductive region.

Figure 8A:
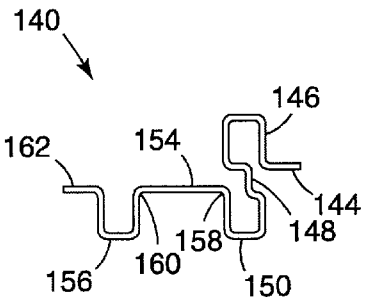
FIGS. 8A–8E illustrate a folding procedure for making a coil from the three-turn coil element of FIG. 7.
Figure 8B:
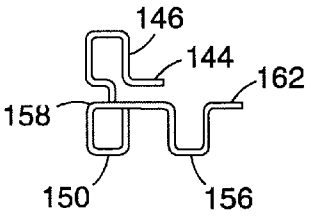
Figure 8C:
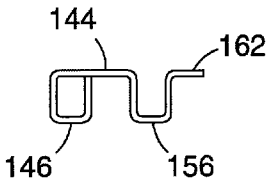
Figure 8D:
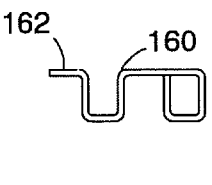
Figure 8E:
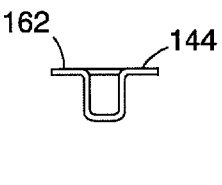

Once the coil element 140 is shaped, it may be laminated as described above. A three turn element may be folded in as many as nine different ways, with each folding method resulting in a different final position for the terminal lead. Of the nine possible folding procedures, four procedures do not require the connector to be folded on itself twice. Referring to FIGS. 8A–8E and FIGS. 9A–9E, two folding methods are shown in which the laminated conductive element is folded about the connector regions and foldable hinge region to create a three-turn coil. The conductive element 140 in FIG. 8A includes a first conductive region 142 with a first terminal 144, a first turn 146, a foldable hinge region 148, and a second turn 150. The second turn 150 is connected to the first end 158 of the connector region 154. The second end 160 of the connector region 154 is connected to a third turn 156. The third turn 156 is connected to the second terminal 162. First, as shown in FIG. 8B, the coil element 140 is folded about the first end 158 of the connector region 154 so that the connector region 154 overlies the foldable hinge region 148 in the first conductive region 142. Next, as shown in FIG. 8C, the coil element 140 is then folded about the hinge region 148 such that the first turn 146 and the second turn 150 in the first conductive region 142 substantially overlie one another. Finally, in FIG. 8D, the conductive element 140 is folded about the second end 160 of the connector region 154 such that the third turn 156 overlies the first turn 146 and second turn 150 and the terminals point in opposite directions. The completed three turn coil is shown in FIG. 8E.

Figure 9A:
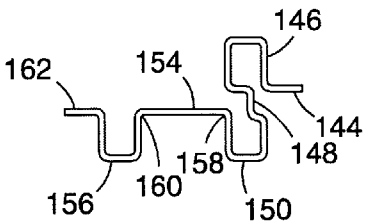
FIGS. 9A–9E illustrate an alternative folding procedure for making a coil from the three-turn coil element of FIG. 7.
Figure 9B:
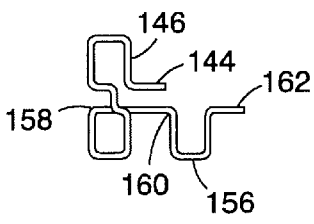
Figure 9C:
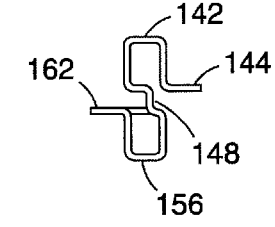
Figure 9D:
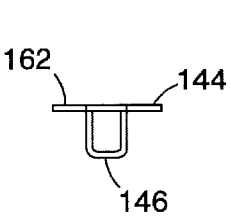
Figure 9E:
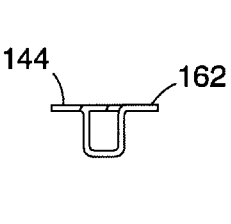

An alternative folding procedure for the three-turn coil element is shown in FIGS. 9A–9E. As shown in FIG. 9B, the coil element 140 may be folded about the first end 158 of the connector region 154 so that the connector region 154 lies under the foldable hinge region 148 in the first conductive region 142. Next, the conductive element 140 is folded about the second end 160 of the connector region 154 as shown in FIG. 9C such that the third turn 156 overlies the second turn 150. Finally, as shown in FIG. 9D, the coil element 140 is then folded about the hinge region 148 such that the first turn 146 and the second turn 150 in the first conductive region 142 substantially overlie one another. The completed three turn coil is shown in FIG. 9E.

Figure 10:
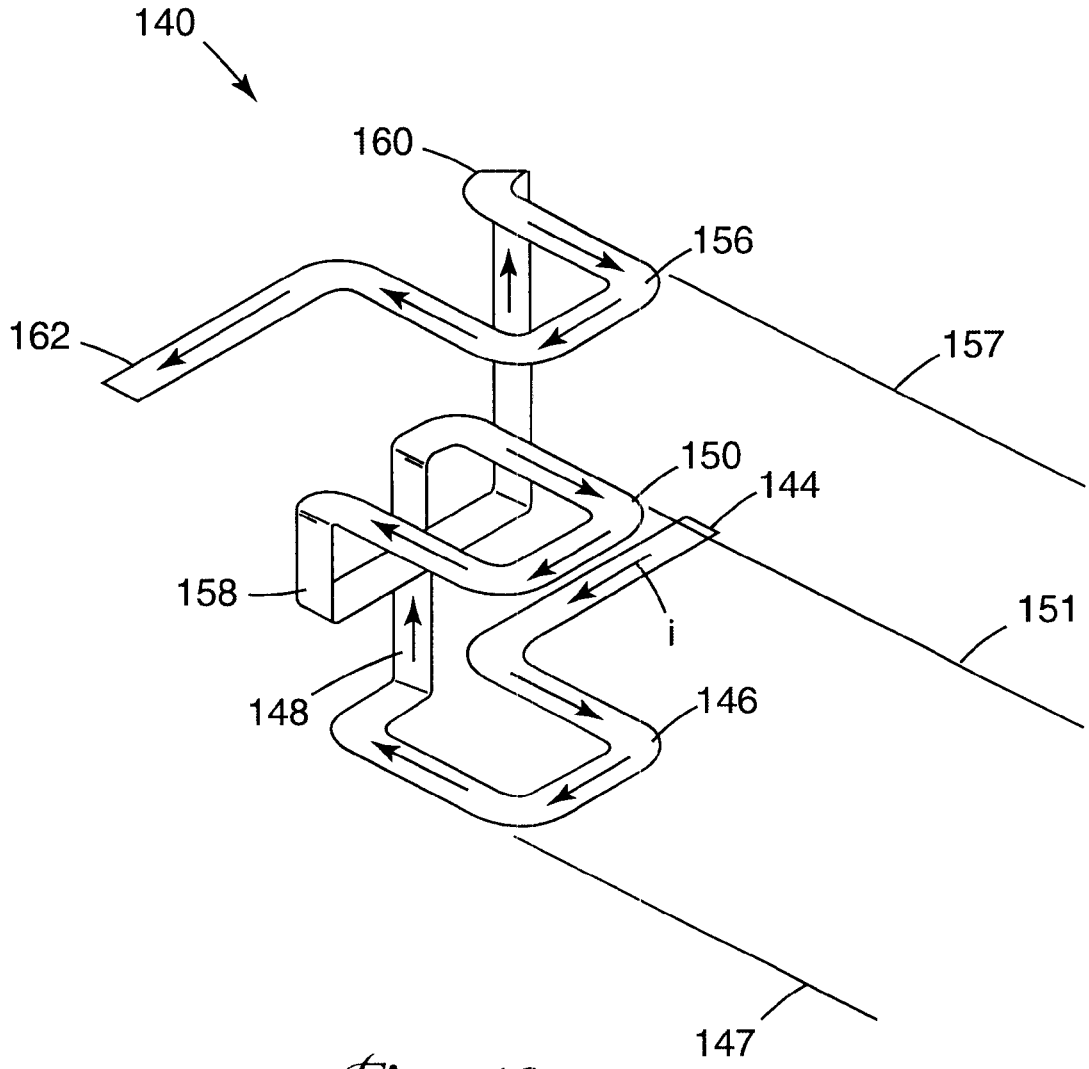
FIG. 10 is a perspective view of a three-turn coil made by folding the coil element of FIG. 7.

As noted above, to optimize the inductive effect in a coil, the current should flow in one direction. A schematic representation of a current flow i in the three-turn coil 140 of FIG. 7 is shown in FIG. 10. Note the location of turns 146, 156, and 150 in substantially parallel planes 147, 157 and 151 respectively.

4 Turn Coils

Figure 11:
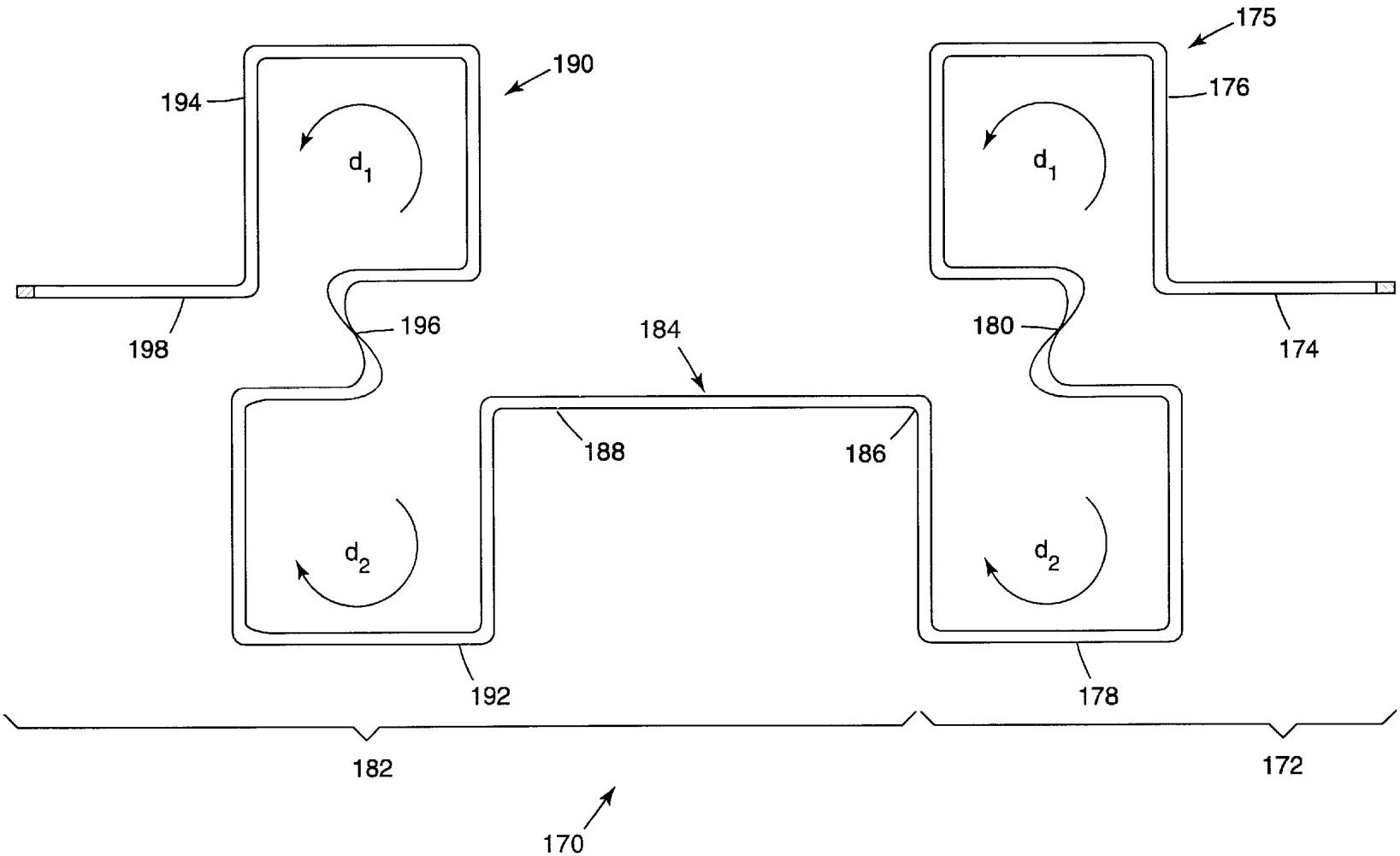
FIG. 11 is an overhead view of an embodiment of a coil element of the present invention having four turns.

Another embodiment of the present invention illustrated in FIG. 11 is a coil element 170 with a first conductive region 172 and a second conductive region 182. The first conductive region 172 includes a first terminal 174 and a substantially S-shaped conductive region 175. The first conductive region 172 includes a first substantially U-shaped turn 176 and a second substantially U-shaped turn 178 connected to one another by a first foldable hinge region 180. For example, an electric current that enters the first conductive region 175 from the first terminal 174 travels in a first direction $d_1$ around the first turn 176 and in a second direction $d_2$ around the second turn 178.

The second conductive region 182 is connected in series with the first conductive region 172 by way of a substantially linear connector region 184 with a first end 186 and a second end 188. The first end 186 of the connector region 184 is connected to the second U-shaped turn 178 of the first conductive region 175. The second end 188 of the connector region 184 is connected to a second substantially reverse S-shaped conductive region 190 having two paired substantially U-shaped turns. The second conductive region 190 includes a third substantially U-shaped turn 192 and a fourth substantially U-shaped turn 194. The third and fourth turns are connected together by a second foldable hinge region 196. When an electric current enters the second conductive region 190, it travels in the same direction $d_2$ around the third turn 192 as the turn 178 it is linked to by the connector region. The current in the fourth turn 192 travels in a direction $d_1$, the same direction as the direction of current travel in the first turn 176. However, as shown below, after folding the current flows in the same direction in all the turns. A second terminal region 198 terminates the second conductive region 182.

Figure 12A:
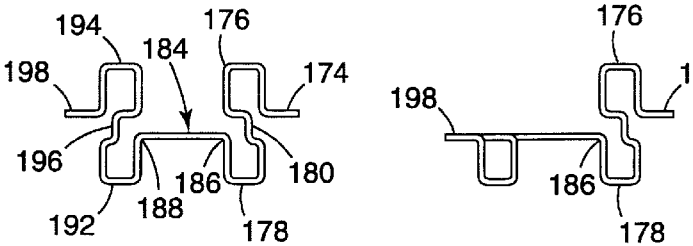
FIGS. 12A–12E are schematic representations of a folding procedure for making a coil from the four-turn coil element of FIG. 11.
Figure 12B:
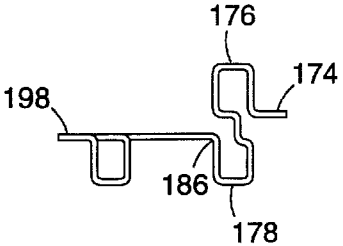
Figure 12C:
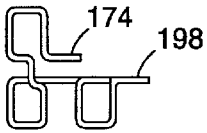
Figure 12D:
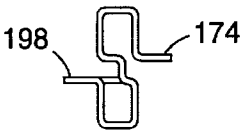
Figure 12E:
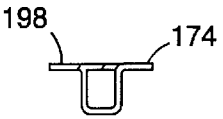

After this coil element 170 is laminated in an insulative material as described above, the coil element may be folded into a multi-turn coil with four turns (See FIGS. 12A–12E). First, referring to FIG. 12B, the conductive element 170 is folded about the second foldable hinge region 196 so that the third and fourth turns 192, 194 substantially overlie one another. The conductive element 170 is then folded about the first end 186 of the connector region 184 as shown in FIG. 12C such that the connector region 184 lies under or over the first foldable hinge region 180. The conductive element 170 is next folded about the second end 188 of the connector region 184 as shown in FIG. 12D such that the second turn 178 substantially overlies the third and fourth turns 192, 194. Finally, the conductive element 170 is folded about the first foldable hinge region 180 as shown in FIG. 12E such that the first turn 176 substantially overlies the second, third and fourth turns 178, 192, 194.

Figure 13:
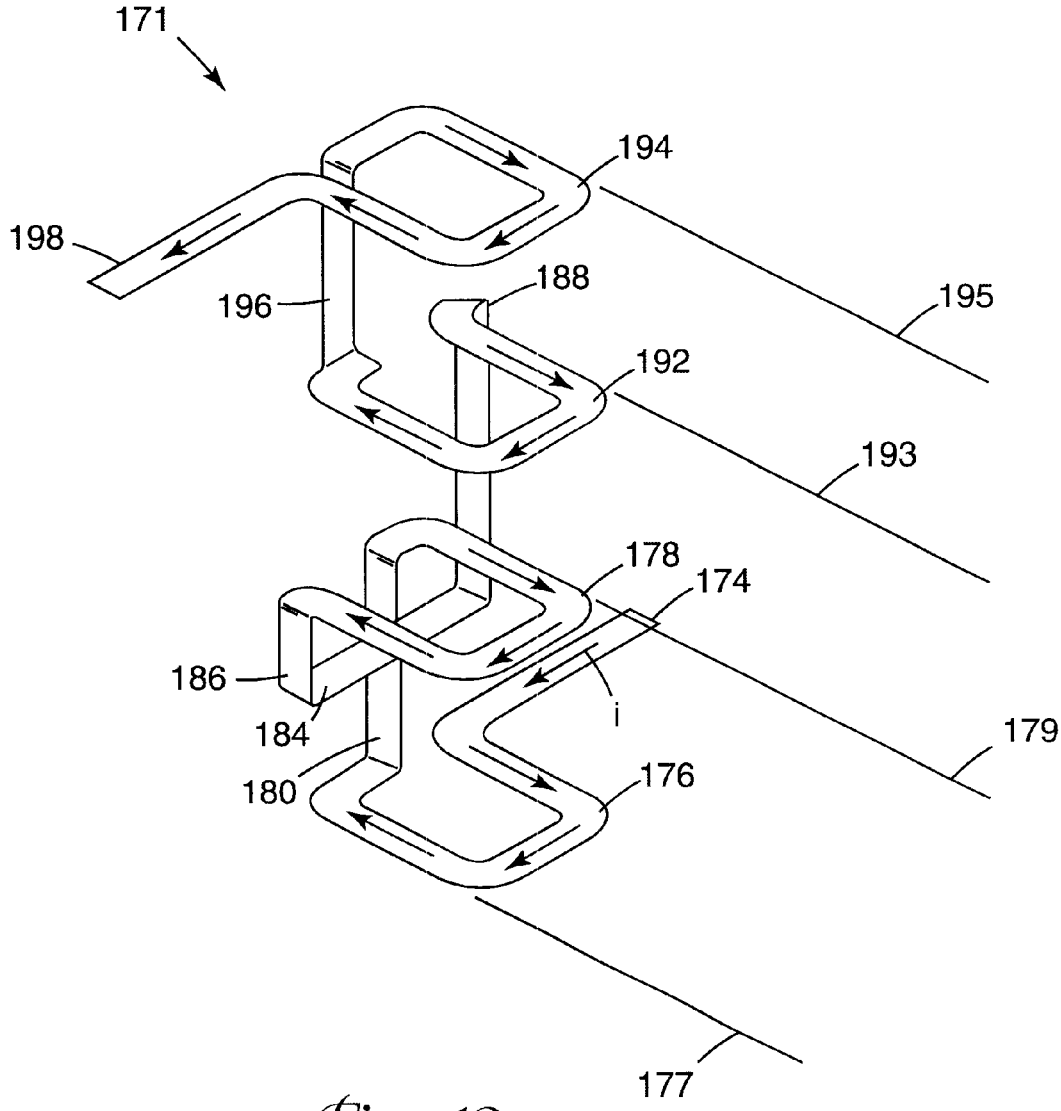
FIG. 13 is a perspective view of a four-turn coil made by folding the coil element of FIG. 11.

After the folding steps are completed, the resulting four-turn coil 171 is shown in FIG. 13. Each of the first and second turns 176, 178 in the first conductive region 175 substantially overlie one another in substantially parallel planes 177, 179, respectively, with the foldable hinge region 180 spanning the planes. Each of the third and fourth turns 192, 194 in the second conductive region 190 substantially overlie one another in parallel planes 193, 195, respectively, with the second foldable hinge region 196 spanning the planes. The third and fourth turns 192, 194 form the first two windings in the coil. The first and second turns 176, 178 in the primary conductive region form the third and fourth turns in the coil. If desired, the adjacent turns of the conductive coil may be adhered to one another using a suitable adhesive.

Using the folding techniques outlined above, a continuous conductive coil with any number of turns may be designed and fabricated. Once the number of turns (n) in the coil is known, a conductive element with a series of conductive regions having a combined total of n turns may be constructed. The shape of the coil element is dependent on how many turns are needed in the multi-turn coil, and on the shape required for each turn.

Multi-Turn Coils

To make a coil with more than two turns, the basic coil elements may be linked in series to form a coil element with multiple turns. The conductive coil element used to make a multi-turn coil is a continuous conductive strip including a first terminal, a second terminal, and a conductive path between the first and the second terminal. The conductive path includes an arrangement of conductive regions linked together in series by a connector region between each conductive region. The conductive regions have at least one and no more than two turns. If a conductive region has a single turn, the turn in that conductive region is connected to an adjacent conductive region in the series by a connector region. When two adjacent turns in the series are connected by a connector region, a current travels around each turns in the same direction. If a conductive region has two turns, the turns in that conductive region are connected to each other by a foldable hinge region.

The adjacent turns may have any desired shape, so long as a current entering the two turn conductive region travels in opposite directions on each side of the foldable hinge region. To provide a coil with good electrical properties, the turns in the two turn conductive regions are acuate, preferable shaped substantially like the letter U. To enhance electrical properties it is preferred that the turns in a two turn conductive region be paired to form a conductive region resembling the letter S. The two turn conductive regions may be made into an S-like shape or a reverse S-like shape. Typically, the coil element will include a substantially S-shaped first conductive region in the series with two turns, followed by a series of additional conductive regions with a combined total of n−2 turns, although such an arrangement is not required.

When a multi-turn coil element is folded into a coil, a conductive region with an S-like shape will cancel the inductive effect of an adjacent conductive region with an S-like shape. Likewise, a reverse S-like shape will cancel the inductive effect of an adjacent reverse S-like shape. To ensure that the current flows in one direction to enhance the inductive effect of a coil, an S-like shape should not be positioned in the series adjacent to another S-like shape, and a reverse S-like shape should not be positioned adjacent to another reverse S-like shape. A preferred configuration to achieve an inductive effect is thus alternating S and reverse S-like shaped conductive regions in series: first terminal, S-like shape, reverse S-like shape, S-like shape, reverse S-like shape . . . second terminal. However, any additional conductive regions with single turns may be inserted into the series as long as the single turns are connected with connector regions. With this arrangement, when the coil element is folded to form a coil, the current passes through all turns of the coil in the same direction.

If the conductive element requires 5 or more turns ($n \geqq 5$), a specific folding protocol is preferred. However, in general, three rules should be followed to bend and fold a coil element efficiently into a multi-turn coil: (1) a connector region in a conductive region is always folded at its end to lie under or over the foldable hinge region in an adjacent two-turn conductive region in the series; (2) each successive connector region closest to the first conductive region is then folded about the foldable hinge region of the first conductive region until the first terminal points away from the second terminal, and there are no more connection regions left to wrap; and (3) if there are two turns in the first conductive region, the turns in the first conductive region in the series should be folded about the foldable hinge region in that conductive region.

Figure 14:
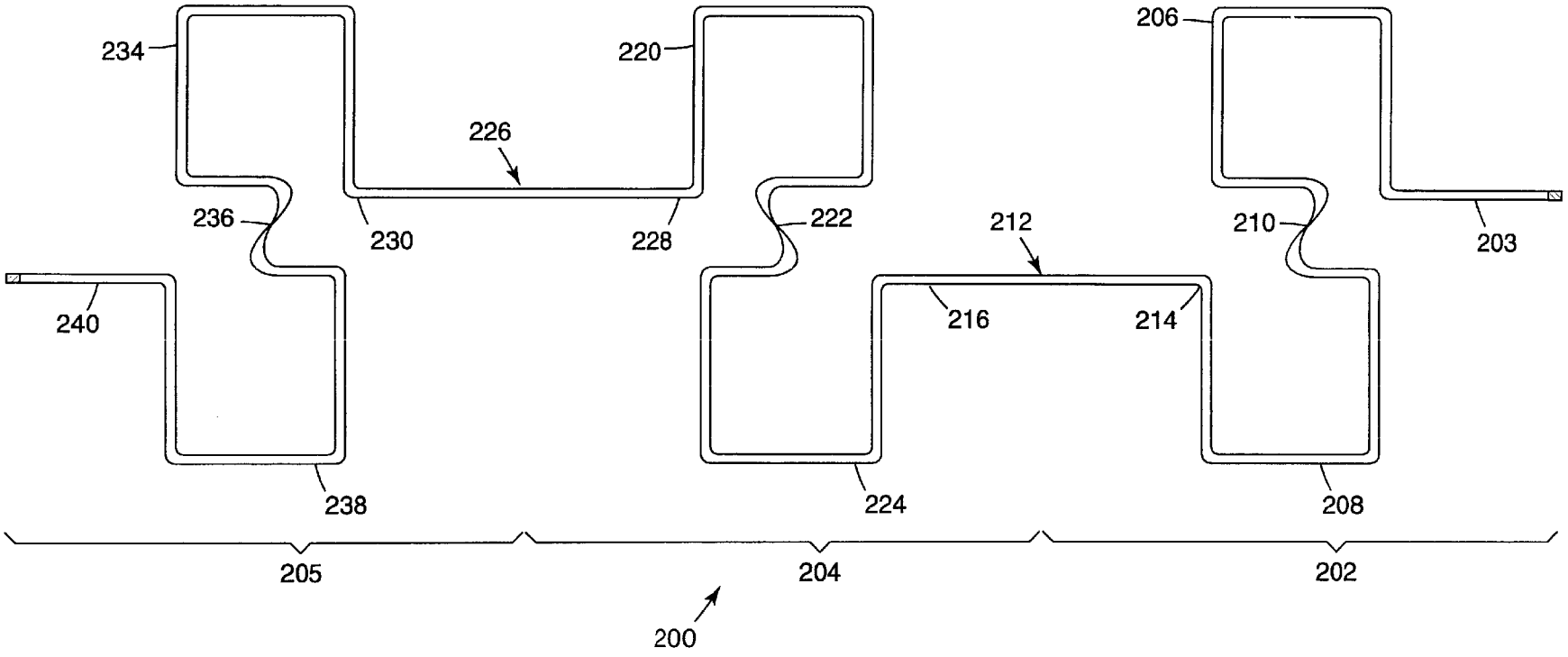
FIG. 14 is an overhead view of a coil element of the present invention having six turns.

The conductive coil element 200 shown in FIG. 14 includes a first conductive region 202 connected in series with a second conductive region 204 and a third conductive region 205. The first conductive region 202 is substantially S-shaped and includes a first terminal 203, a first substantially U-shaped turn 206, a second substantially U-shaped turn 208, and a first foldable hinge region 210. The second U-shaped turn 208 is connected to the second conductive region 204. The second conductive region 204 includes a first connector region 212, which is connected at its first end 214 to the second turn 208. A second end 216 of the connector region 212 is connected to the second substantially reverse S-shaped conductive region 204. The conductive region 204 includes a third substantially U-shaped turn 220, a hinge region 222 and a fourth substantially U-shaped turn 224. The fourth U-shaped turn 224 is connected to a second connector region 226 at its first end 228. The second end 230 of the second connection region 226 is connected to a third substantially S-shaped conductive region 205. The third S-shaped conductive region 205 includes a fifth substantially U-shaped turn 234, a hinge region 236 and a sixth substantially U-shaped turn 238. The sixth turn 238 is connected to a second terminal 240.

A folding procedure for making a 6-turn coil is shown in FIGS. 15A–15F. First, referring to FIGS. 15A–B, the paired substantially U-shaped turns in each of the second and third S-shaped conductive regions 204, 205 are folded at the junction of their respective foldable hinge regions 222, 236 so that the U-shaped turns in each pair (220, 224) and (234, 238) substantially overlie one another. The fifth U-shaped turn 234 is folded about the hinge region 236 to overlie sixth U-shaped turn 238. The fourth U-shaped turn 224 is folded about the hinge region 222 to overlie the third U-shaped turn 220. After this step is completed, all U-shaped turns in the second and third conductive region lie in adjacent parallel planes. Next, in FIG. 15C the first connector region 212 linking the first conductive region 202 and the second conductive region 204 is folded about its first end 214 until the connector region 212 lies behind the foldable hinge region 210 in the first conductive region 202. In FIG. 15D the first connector region 212 is folded at its second end 216 until the third and fourth U-shaped turns 220, 224 substantially overlie the second U-shaped turn 208. In FIG. 15E the second connector region 226 is folded about its first end 228 such that the connector region 226 overlies the foldable hinge region 210 in the first conductive region 202. In FIG. 15F the second connector region 226 is folded about its second end 230 such that the fifth and sixth U-shaped turns 234, 238 substantially overlie the third, fourth and second U-shaped turns 220, 224 and 208. Finally, in FIG. 15G the first U-shaped turn 206 is folded about the first hinge regimen 210 until the first U-shaped turn overlies the remaining U-shaped turns. After this step is complete, the U-shaped turns then substantially overlie one another in substantially parallel planes and form the windings of the multi-turn coil. The windings of the coil may then optionally be bonded together with an adhesive. The resultant coil may then be associated with a core and other windings to form a transformer or incorporated into any electronic circuit or device.

Figure 16:
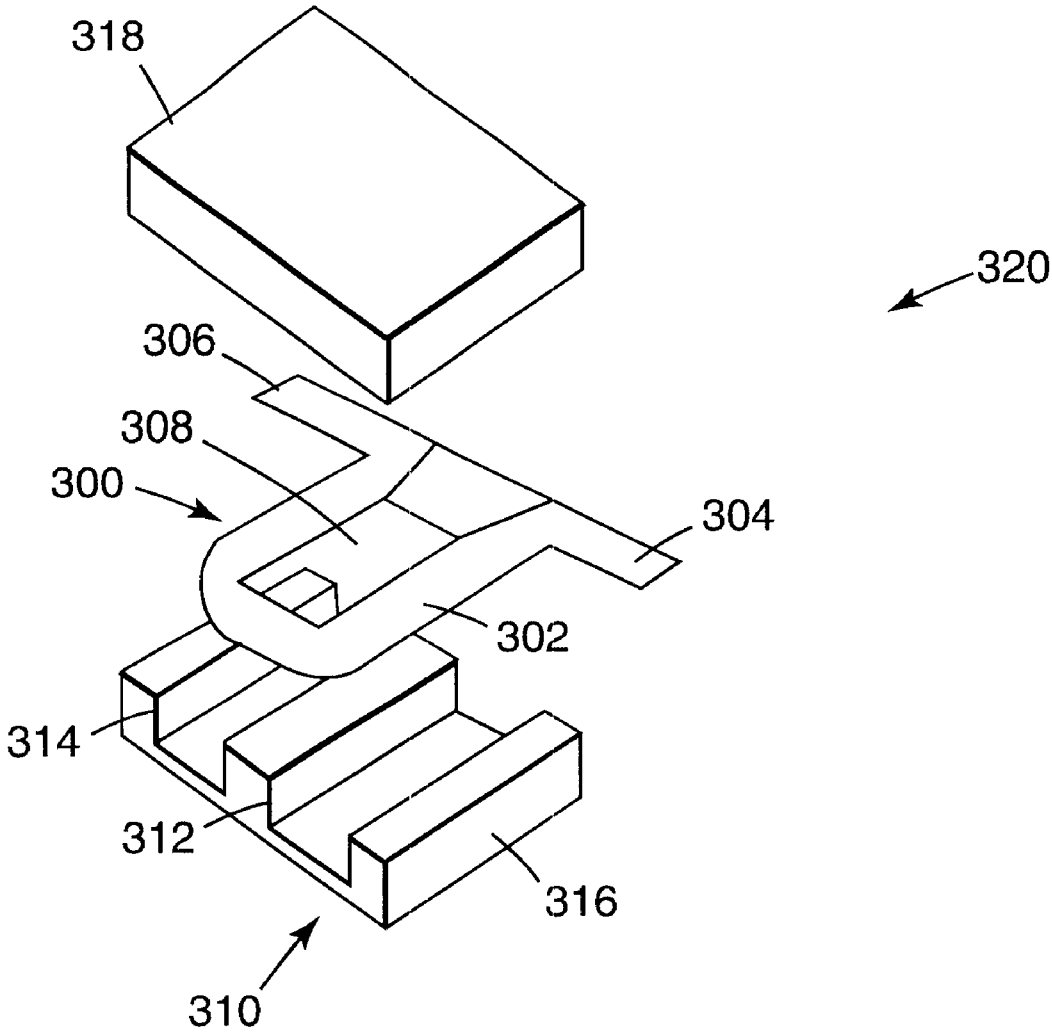
FIG. 16 is an exploded perspective view of a magnetic core with a coil of the present invention.

For example, FIG. 16 shows an embodiment of a completed coil 300 of the present invention used as a component of a transformer. The continuous coil 300 includes a predetermined number of substantially U-shaped windings 302, each substantially overlying one another in substantially parallel planes (not shown in FIG. 16). The coil 300 also includes a first terminal 304 and a second terminal 306. The aperture 308 formed by the stacked overlain windings in the coil member 300 is sized to accept a transformer base member 310. The base member 310, which is typically made of a sintered ferrite or other magnetically susceptible material to provide a flux path for the magnetic field generated by the coil, includes a center channel 312 and peripheral channels 314, 316. The aperture 308 in the coil 300 may be placed over the center channel 312 such that the windings of the coil rest between the peripheral channels 314, 316. A top member 318 may then be used to complete the magnetic core housing of the winding 320.

A number of embodiments of the present invention have been described. Nevertheless, it will be understood that various modifications may be made without departing from the spirit and scope of the invention. Accordingly, other embodiments are within the scope of the following claims.

What is claimed is:

1. A coil element comprising:

a continuous conductive strip including:

a first terminal, a first conductive region with:

a first turn connected to the first terminal, a first foldable hinge region with a first end and a second end, wherein the first end of the first foldable hinge region is connected to the first turn; and a second turn connected to the second end of the first foldable hinge region; wherein a current travels around the first turn in a first direction and around the second turn in a second direction, wherein the first direction is opposite the second direction; and a second conductive region connected in series with the primary conductive region, wherein the second conductive region has:

a connector region with a first end and a second end, wherein the first end of the connector region is connected to the second turn in the first conductive region, a third turn connected to the second end of the connector region, a second foldable hinge region with a first end and a second end, wherein the first end of the hinge region is connected to the third turn, and a fourth turn connected to the second end of the second foldable hinge region, wherein a current travels around the third turn in the second direction and around the fourth turn in the first direction, and a second terminal connected to the fourth turn.

2. The coil element as claimed in claim 1, wherein at least one of the first, second, third and fourth turns are substantially U-shaped.

3. The coil element as claimed in claim 1, wherein at least one of the first and second conductive regions is substantially S-shaped.

4. The coil element as claimed in claim 1, wherein each of the first turn, second turn, the connector region, the third turn and the fourth turn are laminated between layers of a polymeric film.

5. A multi-turn conductive coil comprising:

a continuous conductive strip including a first terminal, a first S-shaped conductive region including:

a first turn in a first plane, wherein the first turn is connected to the first terminal, a first foldable hinge region with a first end and a second end, wherein the first end of the first foldable hinge region is connected to the first turn; and a second turn in a second plane parallel to the first plane, wherein the second turn is connected to the second end of the first foldable hinge region; and a second S-shaped conductive region connected in series with the first conductive region, wherein the secondary conductive region has:

a connector region with a first end and a second end, wherein the first end of the connector region is connected to the second turn in the first conductive region, a third turn in a third plane parallel to the first and second planes, wherein the third turn is connected to the second end of the connector region, a second foldable hinge region with a first end and a second end, wherein the first end of the second hinge region is connected to the third turn, and a fourth turn in a fourth plane parallel to the first, second and third planes, wherein the fourth turn is connected to the second end of the second foldable hinge region wherein a current travels in the same direction around each of the first, second, third and fourth turns; and a second terminal connected to the fourth turn.

6. The multi-turn coil as claimed in claim 5, wherein each of the first turn, the second turn, the third turn and the fourth turn substantially overlie one another.

7. The multi-turn coil as claimed in claim 6, wherein at least two of the first turn, the second turn, the third turn and the fourth turn are adhesively bonded together.

8. The multi-turn coil as claimed in claim 5, wherein each of the first turn, the first hinge region, the second turn, the connector region, the third turn, the second hinge region, and the fourth turn are encapsulated between at least two layers of an insulative polymeric film.

9. A process for making a multi-turn coil, comprising:

(1) providing a coil element comprising a continuous conductive strip including:

a first terminal, a first conductive region including:

a first turn connected to the first terminal, a first foldable hinge region with a first end and a second end, wherein the first end of the first foldable hinge region is connected to the first turn, and a second turn connected to the second end of the first foldable hinge region, wherein a current travels around the first turn in a first direction and around the second turn in a second direction, and the first direction is opposite the second direction; and a second conductive region connected in series with the first conductive region, wherein the second conductive region has:

a connector region with a first end and a second end, wherein the first end of the connector region is connected to the second turn, a third turn connected to the second end of the connector region, a second foldable hinge region with a first end and a second end, wherein the first end of the hinge region is connected to the third turn, and a fourth turn connected to the second end of the second foldable hinge region, wherein the current travels around the third turn in the second direction and around the fourth turn in the first direction; and a second terminal connected to the fourth turn;

(2) encapsulating each of the first turn, the first foldable hinge region, the second turn, the connector region, the third turn, the second foldable hinge region, and the fourth turn in an insulating material comprising at least two sheets of a polymeric film;

(3) folding the coil element about the second foldable hinge region such that the third turn and the fourth turn overlie one another;

(4) folding the coil element about the first end of the connector region such that the connector region lies above or under the first foldable hinge region;

(5) wrapping the connector region about the first foldable hinge region such that the third and fourth turns overlie the second turn; and (6) folding the coil element about the first foldable hinge region such that the first turn overlies the second, third and fourth turns, such that the current in the coil traverses both the first conductive region and the secondary conductive region in the same direction.

10. The process for making a multi-turn coil as claimed in claim 9, wherein at least one of the first, second, third and fourth turns are substantially U-shaped.

11. The process for making a multi-turn coil as claimed in claim 9, further comprising the step of bonding at least two of the first, second, third and fourth turns with an adhesive.

* * * * *